US006467716B1

(12) United States Patent
Hamilton

(10) Patent No.: US 6,467,716 B1
(45) Date of Patent: Oct. 22, 2002

(54) STRAP REEL ADAPTER

(76) Inventor: Frederick W. Hamilton, P.O. Box 198, Newton, MS (US) 39345

( * ) Notice: Subject to any disclaimer, the term of this patent is extended or adjusted under 35 U.S.C. 154(b) by 23 days.

(21) Appl. No.: 09/825,385

(22) Filed: Apr. 3, 2001

(51) Int. Cl.[7] ..... B65H 75/30
(52) U.S. Cl. ..... 242/394; 410/100; 410/103
(58) Field of Search ..... 242/394, 395; 410/100, 103

(56) References Cited

U.S. PATENT DOCUMENTS 898,899 A * 9/1908 Keck
2,632,610 A * 3/1953 Foster et al.
4,290,584 A * 9/1981 Eckels et al.
4,510,652 A * 4/1985 van Iperen
5,156,506 A * 10/1992 Bailey
5,433,565 A * 7/1995 Chan
6,015,111 A * 1/2000 Berke
6,017,173 A * 1/2000 Anthony et al.

* cited by examiner

*Primary Examiner*—William A. Rivera
(74) *Attorney, Agent, or Firm*—Donald J. Ersler

(57) ABSTRACT

A strap reel adapter includes an adapter body and a sliding pin. A drive structure is formed in one end of the adapter body. The drive structure could be a drive cavity or a drive projection. A sliding bore is formed through the other end of the adapter body. The sliding bore is sized to receive the sliding pin. An impact tube is preferably slipped over an outside diameter of the adapter body to reduce the amount of chatter between the strap reel adapter and the strap reel. A retention groove is preferably formed in substantially a middle of the sliding pin and a detent device is formed in a wall of the sliding bore to mate with the retention groove. The detent device keeps the sliding pin centered relative to the adapter body. The ends of the sliding pin are restricted from sliding out of the sliding bore with any suitable retention method. A drive device is used to rotate the strap reel adapter. The drive device could be a ratchet, a power tool, or any other suitable device. The drive device is attached to the drive structure.

22 Claims, 3 Drawing Sheets

STRAP REEL ADAPTER

BACKGROUND OF THE INVENTION

1. Field of the Invention

The present invention relates generally to strap reels and more specifically to a strap reel adapter which allows a strap reel to be rotated faster than is possible with a winding bar.

2. Discussion of the Prior Art

Normally strap reels are tightened using a winding bar. A round end of the winding bar is inserted into two drive apertures. The winding bar is used to rotate the strap reel which winds a strap. Recently, an adapter and ratchet/winch bar manufactured by Quick Winch Products of Overland, Kans. has been introduced. The adapter consists of two pieces. A reel adapter is inserted into an inner diameter of the strap reel and a pin is inserted into a single drive aperture and a hole in the reel adapter. A specially designed ¾ drive ratchet is inserted into a square drive formed in an end of the reel adapter. The strap reel is rotated using the specially designed drive ratchet.

However, the reel adapter and ratchet/winch bar have a few drawbacks. First, the pin may not be removable if the strap becomes tight with the pin adjacent the mounting surface of the strap reel. The clearance between the strap reel and the mounting surface may be too small to allow withdrawal of the pin. Second, the pin only exerts pressure on one drive aperture which may result in premature wear of the drive aperture. Normally, the winding bar is inserted into two drive apertures. Third, the reel adapter and ratchet/winch bar neither teaches or suggest the use of an air power tool, electric power tool, or battery operated power tool to rotate the reel adapter. Using a power tool would reduce reeling time and greatly reduce the physical effort required to reel the strap.

Accordingly, there is a clearly felt need in the art for a strap reel adapter which allows a strap to be more efficiently wound on a strap reel and which allows a strap to be wound on a strap reel with less physical effort.

SUMMARY OF THE INVENTION

The present invention provides a strap reel adapter which is more efficient than that of the prior art. The strap reel adapter includes an adapter body and a sliding pin. A drive structure is formed in one end of the adapter body. The drive structure could be a drive cavity or a drive projection. A sliding bore is formed through the other end of the adapter body. The sliding bore is sized to receive the sliding pin. An impact tube is preferably slipped over an outside diameter of the adapter body to reduce the amount of chatter between the strap reel adapter and a strap reel. A retention groove is preferably formed in substantially a middle of the sliding pin and a detent device is formed in a wall of the sliding bore to mate with the retention groove. The detent device keeps the sliding pin centered relative to the adapter body. The ends of the sliding pin are restricted from sliding out of the sliding bore with any suitable retention method. A drive end of a drive device is attached to the drive structure for rotation of the strap reel adapter. The drive device could be a ratchet, a power tool, or any other suitable device.

Accordingly, it is an object of the present invention to provide a strap reel adapter which may be inserted into and removed from an inside of a strap reel.

It is a further object of the present invention to provide a strap reel adapter which does not have to be assembled for use.

Finally, it is another object of the present invention to provide a strap reel adapter which may be used with either manual or power tools.

These and additional objects, advantages, features and benefits of the present invention will become apparent from the following specification.

DETAILED DESCRIPTION OF THE PREFERRED EMBODIMENTS

Figure 1:
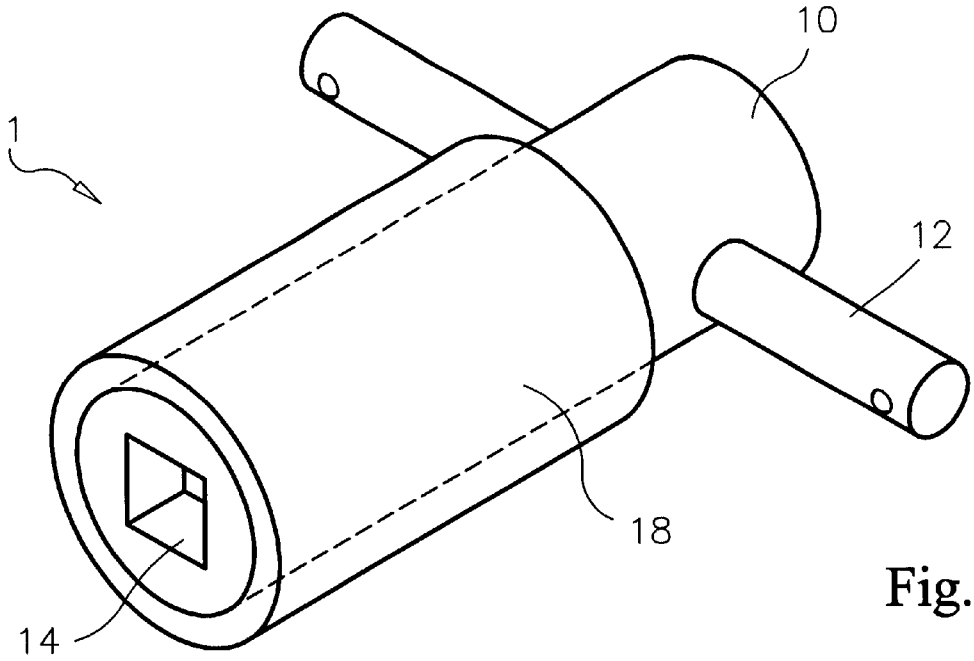
FIG. 1 is a perspective view of a strap reel adapter with a drive cavity in accordance with the present invention.
Figure 1A:
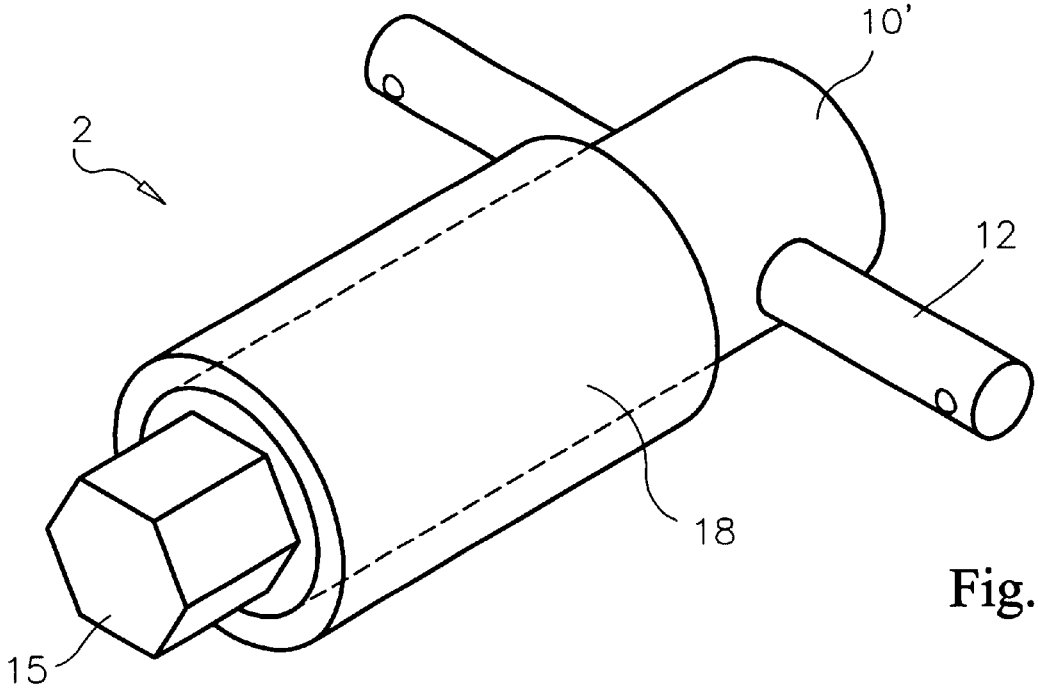
FIG. 1*a* is a perspective view of a strap reel adapter with a drive projection in accordance with the present invention.
Figure 2:
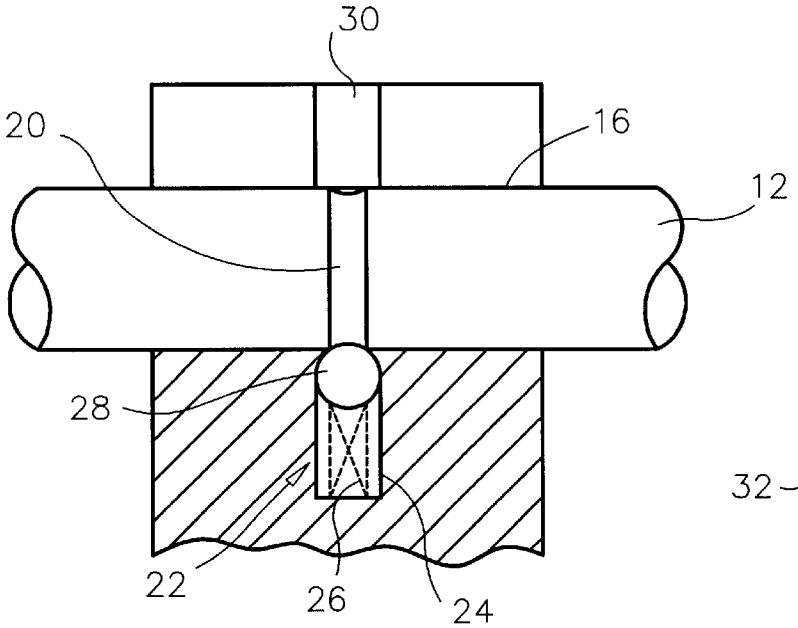
FIG. 2 is an enlarged cross sectional view of a detent device retaining a sliding pin of a strap reel adapter in accordance with the present invention.
Figure 3:
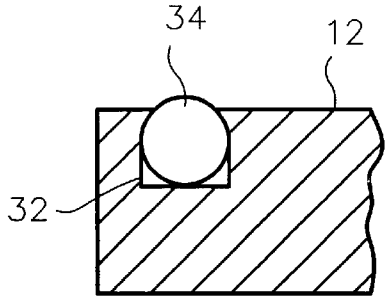
FIG. 3 is an enlarged cross sectional view of an end of a sliding pin of a strap reel adapter in accordance with the present invention.

With reference now to the drawings, and particularly to FIGS. 1 and 1*a*, there is shown a perspective view of a strap reel adapter 1,2. With reference to FIGS. 2 and 3, the strap reel adapters 1,2 include an adapter body 10 and a sliding pin 12. A drive cavity 14 is formed in one end of the adapter body 10 of the strap reel adapter 1. The drive cavity 14 is preferably sized to receive a standard size drive end such as ⅜ inch, ½ inch, or an other appropriate standard such as standard metric drive ends.

A drive projection 15 is formed on one end of the adapter body 10' of the strap reel adapter 2. The drive projection 15 preferably has a hex cross section, but other shaped cross sections may also be used. The drive projection 15 is sized to be received by a chuck of a power tool. The hex cross section allows the drive projection 15 to be more easily retained by a three finger chuck. It is preferable to have a drive projection 15 instead of a drive cavity 14, if a power tool is used. The drive projection 15 eliminates the need for a drive bit to be inserted into the power tool.

A sliding bore 16 is formed through the other end of the adapter body 10. The sliding bore 16 is sized to receive the sliding pin 12. An impact tube 18 is preferably slipped over the adapter body 10 to reduce the amount of chatter between the strap reel adapter 1,2 and a strap reel 100. The impact tube 18 is preferably fabricated from rubber.

A retention groove 20 is preferably formed in substantially a middle of the sliding pin 12 and a detent device 22 is formed in a wall of the sliding bore 16 to mate with the retention groove 20. The detent device 22 preferably includes a detent hole 24, spring 26, and detent ball 28. The detent hole 24 is formed in the other end of the adapter body 10. The detent hole 24 is sized to slidably receive the detent ball 28. The spring 26 is inserted into the detent hole 24 before insertion of the detent ball 28. The detent ball 28 is preferably retained in the detent hole 24 by peening an edge of the detent hole 24 over the detent ball 28 with a peening tool. The peening tool may be inserted through a peen hole 30. The spring 26 forces the detent ball 28 into the retention groove 20 to retain the sliding pin 12 in a drive position after insertion into an inner diameter of the strap reel 100. Other devices or methods may also be used to retain the sliding pin 12 in a drive position.

The ends of the sliding pin 12 are restricted from sliding out of the adapter body 10. Preferably, a ball hole 32 is formed on each end of the sliding pin 12. A retention ball 34 is placed in each ball hole 32. The retention ball 34 is retained in the ball hole 32 by peening an edge of the ball hole 32 over the retention ball 34. Other methods may also be used to retain the sliding pin 12 in the adapter body 10.

Figure 4:
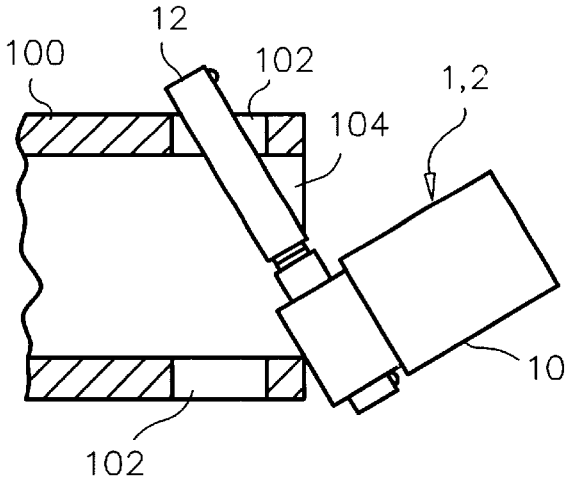
FIG. 4 is a cross sectional view of a reel strap adapter partially inserted into a strap reel in accordance with the present invention.
Figure 5:
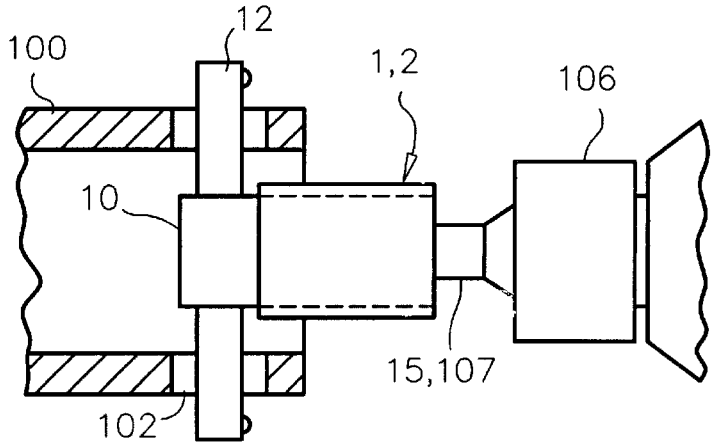
FIG. 5 is a cross sectional view of a reel strap adapter fully inserted into a strap reel in accordance with the present invention.
Figure 6:
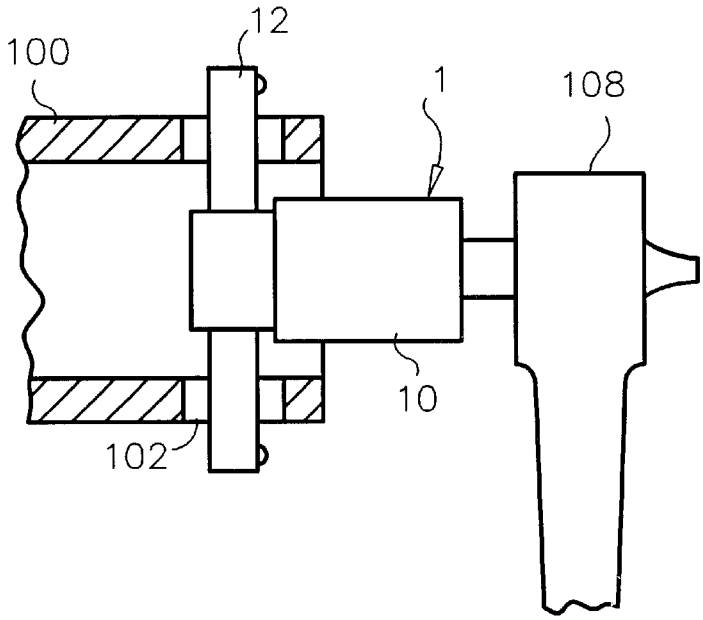
FIG. 6 is a cross sectional view of a reel strap adapter fully inserted into a strap reel and driven by a ratchet in accordance with the present invention.
Figure 7:
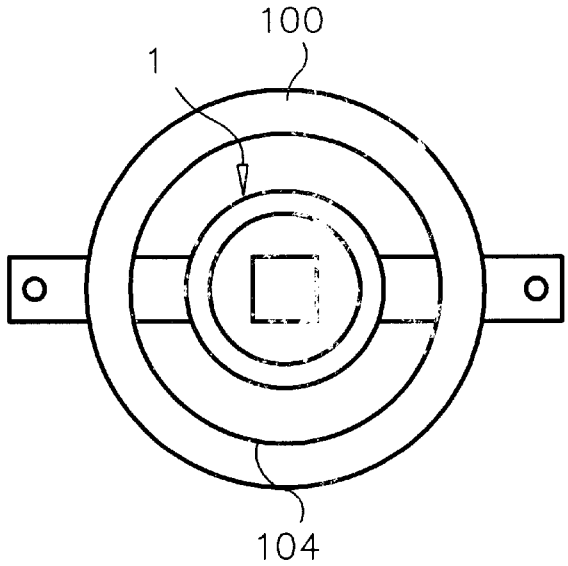
FIG. 7 is an end view of a reel strap adapter inserted into a strap reel in accordance with the present invention.

With reference to FIGS. 4–7, the strip reel adapters 1,2 are preferably used in the following manner. The sliding pin 12 is slid to one end of the adapter body 10 as shown in FIG. 4. The long end of the sliding pin 12 is inserted into one of the drive apertures 102 of the strap reel 100 and the adapter body 10 inserted into an inner diameter 104 of the strap reel 100. The sliding pin 12 is then pushed downward until each end of the sliding pin 12 is in one of the drive apertures 102. The strap reel adapter 1 may now be rotated with a drive device such as a power tool 106, ratchet 108, or any other suitable device. The power tool 106 could be operated by air, electricity, or a battery. However, the power tool 106 would also require a drive bit 107. One end of the drive bit 107 would be inserted into the drive cavity 14 and the other end in a chuck of the power tool 106. The drive projection 15 may be substituted for the drive cavity 14. The drive projection 15 is inserted directly into a chuck of a power tool 106. The strap reel adapters 1,2 may be rotated with the power tool 106.

Figure 8:
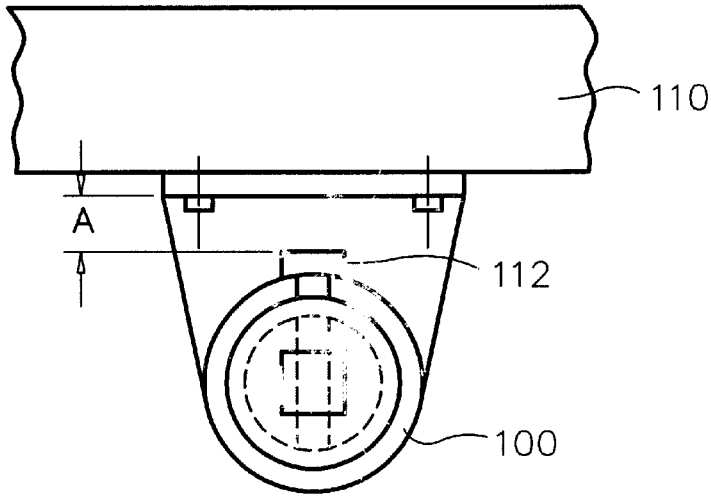
FIG. 8 is an end view of a prior art device inserted in a strap reel.

FIG. 8 shows an end view of a strap reel 100 mounted under a flat bed trailer 110 and a prior art device inserted in the strap reel 100. Some strap reels 100 are mounted tightly under flat bed trailers as shown in FIG. 8. If the strap becomes tight and the position of the pin is as shown in FIG. 8, the clearance of dimension "A" may not be sufficient to allow the pin 112 to be withdraw. The strap would have to be loosen and the pin reinserted into a different drive aperture 102. However, the strap reel adapters 1,2 do not have such a limitation. The strap reel adapters 1,2 are inserted into and removed from an inner diameter 104 of the strap reel 100.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A strap reel adapter capable of being inserted into at least one drive aperture of a strap reel comprising:

an adapter body having a drive structure formed on one end and a sliding bore formed through the other end thereof;

a sliding pin being sized to be received by said sliding bore, a ball hole being formed in at least one end of said sliding pin, a retention ball being placed in each said ball hole, said retention ball being retained by peening of an edge of said ball hole over said retention ball; and a drive end of a drive device being attached to said drive structure, wherein said strap reel adapter being inserted into a strap reel and rotated utilizing said drive device.

2. The strap reel adapter capable of being inserted into at least one drive aperture of a strap reel of claim 1, further comprising:

said drive structure being a drive cavity.

3. A strap reel adapter capable of being inserted into at least one drive aperture of a strap reel of claim 2 wherein:

a drive bit of a ratchet being inserted into said drive cavity, said ratchet being used to rotate said strap reel adapter.

4. The strap reel adapter capable of being inserted into at least one drive aperture, of a strap reel of claim 1, further comprising:

said drive structure being a drive projection.

5. The strap reel adapter capable of being inserted into at least one drive aperture of a strap reel of claim 4 wherein:

said drive projection being inserted into a chuck of a power tool, said power tool being used to rotate said strap reel adapter.

6. The strap reel adapter capable of being inserted into at least one drive aperture of a strap reel of claim 1, further comprising:

a detent device being formed in a wall of said sliding bore, a retention groove being formed in substantially a middle of said sliding pin, said retention groove being sized to receive an end of said detent device.

7. The strap reel adapter capable of being inserted into at least one drive aperture of a strap reel of claim 1, further comprising:

an impact tube being attached to an outer diameter of said adapter body.

8. The strap reel adapter capable of being inserted into at least one drive aperture of a strap reel of claim 1 wherein:

each end of said sliding pin being constrained from sliding out of said sliding bore.

9. A strap reel adapter capable of being inserted into at least one drive aperture of a strap reel comprising:

an adapter body having a drive cavity formed in one end and a sliding bore formed through the other end thereof;

a sliding pin being sized to be received by said sliding bore, a retention groove being formed in substantially a middle of said sliding pin, a detent device being formed in a wall of said sliding bore, said retention groove being sized to receive an end of said detent device; and a drive end of a drive device being attached to said drive cavity, wherein said strap reel adapter being inserted into a strap reel and rotated utilizing said drive device.

10. The strap reel adapter capable of being inserted into at least one drive aperture of a strap reel of claim 9, further comprising:

said detent device including a detent ball and a spring, a detent hole being formed in said wall of said sliding bore, said spring and said detent ball being inserted into said detent hole, said detent ball being retained by peening an edge of said detent hole.

11. The strap reel adapter capable of being inserted into at least one drive aperture of a strap reel of claim 9, further comprising:

an impact tube being attached to an outer diameter of said adapter body.

12. The strap reel adapter capable of being inserted into at least one drive aperture of a strap reel of claim 11 wherein:

each end of said sliding pin being constrained from sliding out of said sliding bore.

13. The strap reel adapter capable of being inserted into at least one drive aperture of a strap reel of claim 12 wherein:

a ball hole being formed in at least one end of said sliding pin, a retention ball being placed in each said ball hole, said retention ball being retained by peening of an edge of said ball hole over said retention ball.

14. The strap reel adapter capable of being inserted into at least one drive aperture of a strap reel of claim 9 wherein:

said drive cavity having a square shape.

15. The strap reel adapter capable of being inserted into at least one drive aperture of a strap reel of claim 9 wherein:

a drive end of a ratchet being inserted into said drive cavity, said ratchet being used to rotate said strap reel adapter.

16. The strap reel adapter capable of being inserted into at least one drive aperture of a strap reel of claim 9 wherein:

a drive bit being inserted into a chuck of a power tool, said drive bit being inserted into said drive cavity, said power tool being used to rotate said strap reel adapter.

17. A method of rotating a strap reel including the steps of:

(a) providing an adapter body having a first end and a second end, a sliding bore being formed through said second end thereof;

(b) providing a sliding pin which is sized to be received by said sliding bore, a detent device being formed in a wall of said sliding bore, a retention groove being formed in substantially a middle of said sliding pin, said retention groove being sized to receive an end of said detent device;

(c) attaching a first end of said adapter body to a drive end of a power tool; and (d) inserting each end of said sliding pin into a drive aperture of the strap reel and rotating the strap reel with said power tool.

18. The method of rotating a strap reel of claim 17, further comprising:

a drive cavity being formed in said first end of said adapter body, one end of a drive bit being inserted into said drive cavity the other end being inserted into a chuck of said power tool.

19. The method of rotating a strap reel of claim 17, further comprising:

a drive projection being formed on said first end of said adapter body, said drive projection being inserted into a chuck of said power tool.

20. The method of rotating a strap reel of claim 17, further comprising:

an impact tube being attached to an outer diameter of said adapter body.

21. The method of rotating a strap reel of claim 17, further comprising:

each end of said sliding pin being constrained from sliding out of said sliding bore.

22. The method of rotating a strap reel of claim 17, further comprising:

a ball hole being formed in at least one end of said sliding pin, a retention ball being placed in each said ball hole, said retention ball being retained by peening of an edge of said ball hole over said retention ball.

* * * * *